US006193543B1

(12) United States Patent
Howard et al.

(10) Patent No.: US 6,193,543 B1
(45) Date of Patent: Feb. 27, 2001

(54) ADJUSTABLE RETAINER FOR ELECTRICAL CORDS

(75) Inventors: Carol A. Howard, Oxford; Ward E. Strang, Fairfield; John J. Putorti, Seymour, all of CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/475,471

(22) Filed: Dec. 30, 1999

(51) Int. Cl.[7] ..... H01R 13/58
(52) U.S. Cl. ..... 439/459; 439/460
(58) Field of Search ..... 439/456, 459, 439/460, 475; 174/92, 93

(56) References Cited

U.S. PATENT DOCUMENTS

| | | | | |
|---|---|---|---|---|
| 3,784,961 | | 1/1974 | Gartland, Jr. . | |
| 3,856,376 | | 12/1974 | Poliak et al. . | |
| 4,963,104 | | 10/1990 | Dickie . | |
| 5,217,389 | | 6/1993 | MacKay et al. . | |
| 5,304,075 | | 4/1994 | Hoffman . | |
| 5,338,222 | | 8/1994 | Boteler . | |
| 5,397,859 | * | 3/1995 | Robertson et al. | 174/92 |
| 5,562,483 | | 10/1996 | Hoffman . | |
| 5,606,150 | * | 2/1997 | Radliff et al. | 174/92 |

* cited by examiner

*Primary Examiner*—Khiem Nguyen
*Assistant Examiner*—Hae Moon Hyeon
(74) *Attorney, Agent, or Firm*—Alfred N. Goodman; Mark S. Bicks; Tara L. Hoffman

(57) ABSTRACT

A housing for an electrical wiring device includes an adjustable clamping mechanism for retaining electrical conduits therein. The clamping mechanism has a pair of opposing strain relief members on opposite sides of a conduit passageway, set to accept a predetermined conduit width. Each strain relief member has a frangible portion which can be removed by a user. In this manner, if a user desires to retain, by means of an interference fit, a conduit having a diameter larger than the predetermined spacing of the intact strain relief members will allow, one or both frangible portions can be removed to accommodate a larger sized conduit. Alternatively, more than one pair of strain relief members having frangible portions can be alternately arranged to clamp a conduit in an S-shaped configuration, capable of accepting multiple conduit sizes by removing some or all of the frangible portions. Preferably, the strain relief members are integrally formed with the housing, and each frangible portion is integrally formed with the remainder of the strain relief member and the housing.

19 Claims, 4 Drawing Sheets

ADJUSTABLE RETAINER FOR ELECTRICAL CORDS

FIELD OF THE INVENTION

This invention relates to an electrical wiring device that includes an adjustable clamping mechanism for retaining electrical cords or conduits of varying diameters within an electrical housing. More specifically, the invention relates to a cord clamping mechanism, having frangible components, capable of being adapted to retain cords of varying diameters within an electrical housing.

BACKGROUND OF THE INVENTION

The conventional means for accommodating a wide range of conduit or cord diameters within an electrical device has been to use a removable or expandable conduit clamp. For example, a conduit clamp capable of accommodating a small diameter conduit can be removed when a larger diameter conduit is desired. The clamp reduces the opening size of the electrical device, thereby allowing the conduit clamp to effectively grip the smaller diameter conduit within the opening.

Such removable clamps have several disadvantages. The electrical devices are manufactured with the clamps installed and ready to receive a predetermined diameter conduit. A user has the option to order electrical devices having clamps capable of retaining conduits of a predetermined diameter. If the user procures electrical devices with clamps that can retain only smaller diameter conduits than required, the user can remove the clamps in order to accommodate a larger conduit. However, if the user does not remove the clamps, and attempts to insert the larger conduit, the conduit can be damaged. Additionally, if the user removes the clamps, there will be no retaining mechanism remaining within the electrical device.

Permanent adjustable clamps have also been utilized, however they require both rotary and translational movement to be effective and are usually complicated and costly to make and assemble. See, for example, U.S. Pat. No. 5,217,389 to MacKay et al and U.S. Pat. No. 5,562,483 to Hoffman.

Thus, a need exists to provide an electrical device with a clamp capable of retaining various sizes of conduit, whereby a user can alter the clamp to retain larger diameter conduit.

SUMMARY OF THE INVENTION

Accordingly, a primary object of the invention is to provide a conduit clamping mechanism that can be enlarged and therefore usable with various diameter conduit and that is relatively simple and cheap to make and assemble.

Another object of the invention is to provide a conduit clamping mechanism that increases the retainer opening by removing a frangible portion of the conduit clamp.

Another object of the invention is to provide a conduit clamp in which retainer members are located both within the housing and on a cover, resulting in side to side and top to bottom clamping of the conduit.

The foregoing objects are basically attained by providing an electrical wiring device having a housing, the housing having a longitudinal axis, and a passageway for receiving an electrical conduit therein; a clamping means, attached to the housing, for clamping the electrical conduit within the passageway, the clamping means having a first retaining member and a second retaining member, the first and second retaining members located on opposite sides of the passageway, the first retaining member having a first frangible portion located substantially transversely of the longitudinal axis, the second retaining member located substantially transversely of the longitudinal axis, wherein the conduit having a first diameter is retained between the first and second retaining members.

The foregoing objects are also attained by providing an electrical wiring device comprising a housing having a longitudinal axis, and a passageway for receiving an electrical conduit therein; a first clamping means, attached to the housing, for clamping the electrical conduit within the passageway, the first clamping means having a first retaining member and a second retaining member, the first and second retaining members located on opposite sides of the passageway, the first and second retaining members separated by a first predetermined distance, the first retaining member having a first frangible portion located substantially transversely of the longitudinal axis, the second retaining member having a second frangible portion located substantially transversely of the longitudinal axis; wherein the conduit having a first diameter is retained between the first and second retaining members; wherein when the first frangible portion is removed from the first retaining member, a second predetermined distance between the first retaining member and the second retaining member greater than the first predetermined distance results, and a second conduit having a second diameter greater than the first diameter can be retained between the first and second retaining members; and wherein when the first and second frangible portions are removed from the first and second retaining members, a third predetermined distance greater than the first predetermined distance results, and a third conduit having a third diameter greater than the first diameter can be retained between the first and second retaining members.

The foregoing objects are also attained by providing an electrical wiring device comprising a housing having a longitudinal axis, and a passageway for receiving an electrical conduit therein; a first clamping means, attached to said housing, for clamping the electrical conduit within said passageway, the first clamping means having a first retaining member and a second retaining member, the first and second retaining members located on opposite sides of the passageway, the first and second retaining members separated by a first predetermined distance, the first retaining member having a first frangible portion located substantially transversely of the longitudinal axis, the second retaining member having a second frangible portion located substantially transversely of the longitudinal axis, wherein the conduit having a first diameter is retained between the first and second retaining members, wherein when the first frangible portion is removed from the first retaining member, a second predetermined distance between the first retaining member and the second retaining member greater than the first predetermined distance results, and a second conduit having a second diameter greater than the first diameter can be retained between the first and second retaining members, wherein when the first and second frangible portions are removed from the first and second retaining members, a third predetermined distance greater than the first predetermined distance results, and a third conduit having a third diameter greater than the first diameter can be retained between the first and second retaining members; a second clamping means, attached to the housing, for clamping the electrical conduit within the passageway, the second clamping means having a fourth predetermined distance apart from the first clamping means, the second clamping means having a third retaining member and a fourth retaining member, the third and fourth retaining members located on opposite sides of the passageway, the third and fourth retaining members separated by a fifth predetermined distance, the third retaining member having a third frangible portion located substantially transversely of the longitudinal axis, the fourth retaining member having a fourth frangible portion located substantially transversely of the longitudinal axis, wherein the conduit having a first diameter is retained between the first and second retaining members and between the third and fourth retaining members, wherein when the third frangible portion is removed from the third retaining member, the second predetermined distance between the first and second retaining members is also between the third and fourth retaining members, and the second conduit can be retained between the first and second retaining members and the third and fourth retaining members, and wherein when the third and fourth frangible portions are removed from the third and fourth retaining members, the third predetermined distance between the third and fourth retaining results, and the third conduit can be retained between the first and second retaining members and the third and fourth retaining members.

Other objects, advantages and salient features of the invention will become apparent from the following detailed description, which taken in conjunction with the annexed drawings, discloses preferred embodiments of the invention.

DRAWINGS

Referring now to the drawings which form a part of this original disclosure:

DETAILED DESCRIPTION OF THE INVENTION

Figure 1:
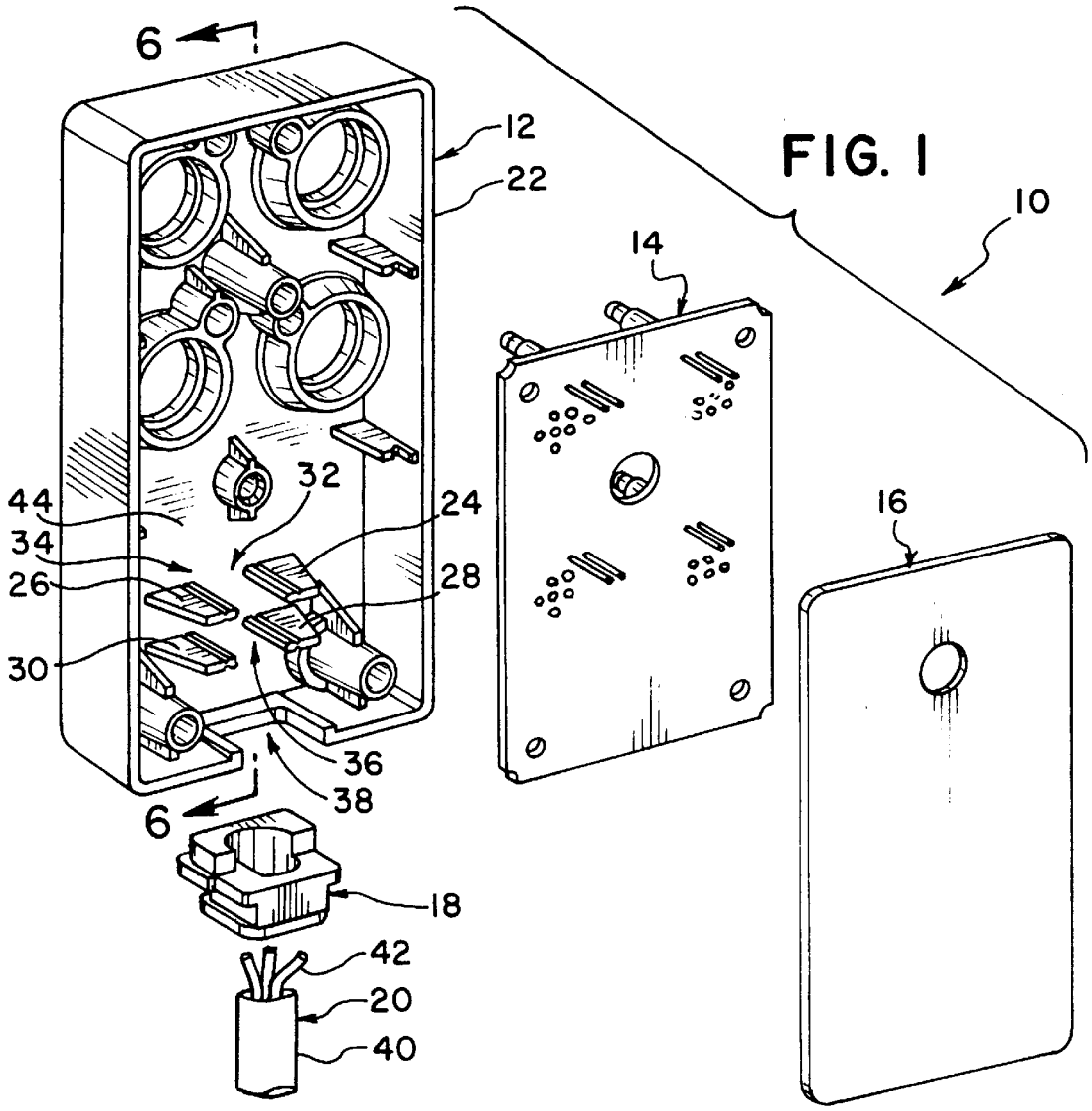
FIG. 1 is an exploded perspective view of the electrical wiring device in accordance with the first embodiment of the invention.

As seen in FIGS. 1–6, an electrical wiring device 10 in accordance with the first embodiment of the present invention is illustrated, and includes a housing 12, a circuit board 14 received in the housing 12, a cover 16 for covering the circuit board 14, a grommet 18 also received in the housing 12, and electrical conduit 20 which is received through the grommet 18 and into the housing 12. Housing 12 comprises a housing body 22, and retaining members 24, 26, 28 and 30 attached to the housing body 22. Retaining members 24 and 26 are located on opposite sides of passageway 32, and retaining members 28 and 30 are located on opposing sides of passageway 32. Two retaining members 24, 26 form a first retaining clamp 34, and the two retaining members 28, 30 form a second retaining clamp 36. When conduit 20 passes through grommet 18, conduit 20 can be retained by the first retaining clamp 34 and the second retaining clamp 36. The first and second retaining clamps 34, 36 hold the conduit in place by means of an interference fit. An interference fit is accomplished when conduit 20 is pressed between two retaining members 24, 26 or 28, 30, resulting in the conduit 20 being squeezed and resisting further longitudinal movement. That is, conduit 20 is held in passageway 32 by being forced between two retaining members 24, 26 and/or 28, 30.

Grommet 18 is received in housing opening 38, and allows the pass through of conduit 20 into housing 12. Grommet 18 is preferably flexible and may be fabricated from any rubber or rubber like material having flexible properties.

Conduit 20 can be any conduit or cord known in the art that can carry electrical wires, cable, optical fibers, and the like. It is preferable that the outer sheathing 40 of conduit 20 is flexible and resilient, and that electrical wires 42 covered by sheathing 40 also be flexible and resilient. Typically more than one wire 42 is covered by the outer sheathing 40 in conduit 20. Wires 42 may also be covered by an insulative material, such as a shrink fit plastic to prevent shorting between other wires 42 within the conduit 20 and to prevent piercing or breaking of the wire from sources exterior to the conduit 20.

Figure 2:
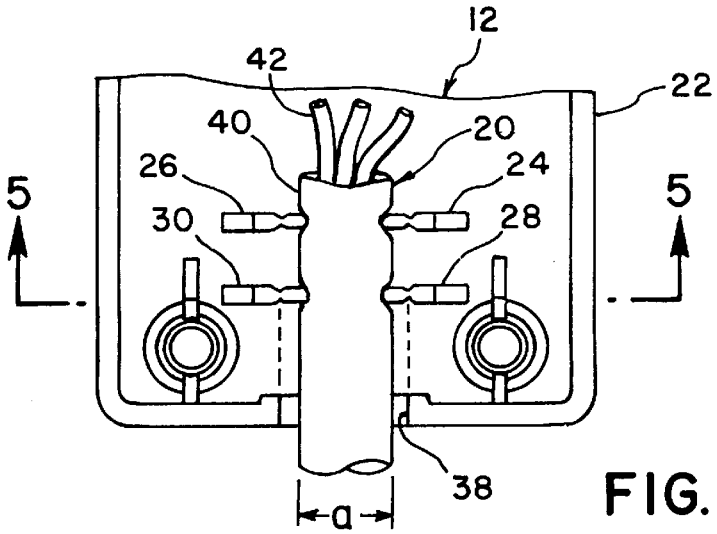
FIG. 2 is a rear elevational view of the electrical wiring device with a small diameter conduit coupled therein, and with the rear cover removed to show the retaining mechanism of FIG. 1 gripping the conduit.
Figure 5:
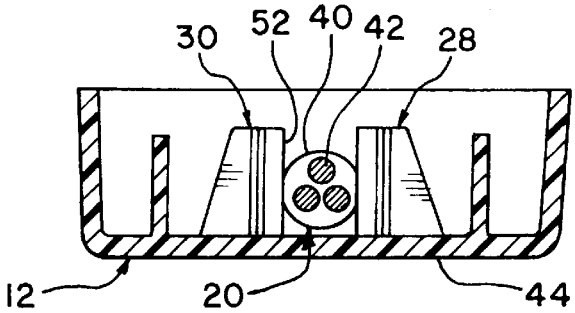
FIG. 5 is a cross-sectional elevational view of the wiring device shown in FIG. 2 taken along line 5—5.
Figure 6:
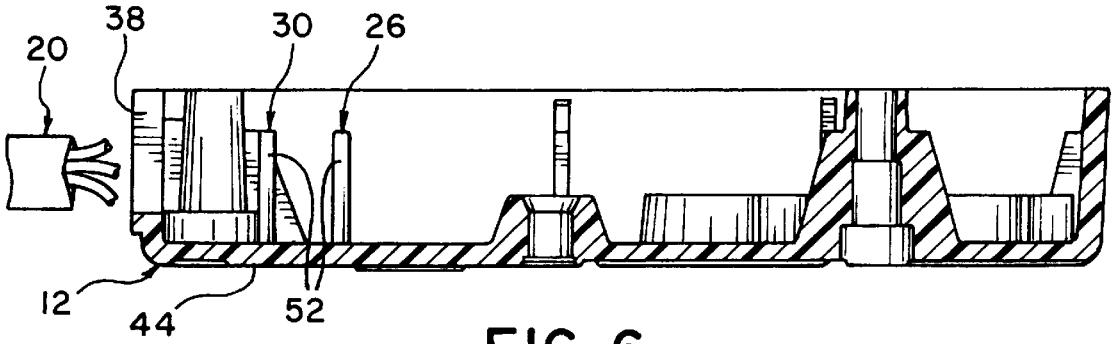
FIG. 6 is a cross-sectional view of the electrical wiring device housing taken along line 6—6 of FIG. 1.

Conduit 20 must be sufficiently flexible to be retained in passageway 32 by way of an interference fit with the first and/or second retaining clamps 34, 36. That is, when conduit 20 is pressed into clamp 34, 36, conduit 20 can be adequately deformed and held in place within passageway 32. FIG. 2 illustrates conduit 20 in the interference fit with retaining members 24, 26, 28, 30. FIG. 5 illustrates conduit 20 in the interference fit between retaining members 28, 30. The outer sheathing 40 is indented and flattened on two sides due to the forces applied by the retaining members 28, 30.

Circuit board 14 is inserted into the housing 12 and is electrically connected to wires 42. The circuit board 14 is any conventional circuit board known in the art, and may be a printed circuit board.

Cover 16 covers the circuit board 14 and can cover part or all of the area where conduit 20 is retained in passageway 32. Cover 16 can be a thin paper or label glued or otherwise attached to housing 12, or may be fabricated from a rigid material that can be attached to the housing 12 by means of a fastener, an adhesive, a snap fit, or other attachment means.

Housing 12 may be fabricated from any conventional plastic that can be injection molded or any other material that can be cast into a rigid or semi-rigid housing. Retaining members 24, 26, 28, 30 may be, and are preferably, fabricated from the same material as housing 12, and may be, and are preferably, fabricated at the same time as and be integral with housing 12.

As seen in FIG. 2, retaining members 24, 26, 28, 30 are positioned in housing 12 to retain small conduit 20 having a nominal diameter "a". Conduit 20 is retained between a pair of retaining members 24, 26 and between the pair of retaining members 28, 30 in an interference fit whereby opposing sides of conduit 20 are effectively pinched, resulting in a gripping of conduit 20. The grip on conduit 20 by retaining members 24, 26, 28, 30 results in an increase in the amount of longitudinal force required to move conduit 20. In this manner, conduit 20 is held in place absent a significant longitudinal force to reposition the conduit 20.

Figure 3:
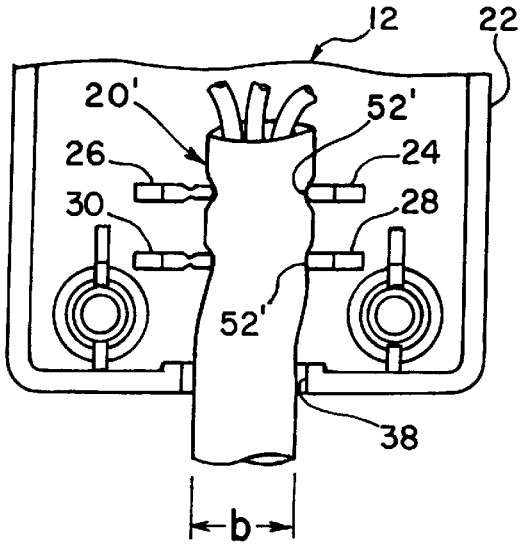
FIG. 3 is similar to FIG. 2, but shows a medium diameter conduit retained in the clamping mechanism wherein two frangible portions have been removed.

Retaining members 24, 26, 28, 30 all have a frangible portion 48 that can be selectively removed. When a frangible portion 48 is removed from retaining members 24, 28 or retaining members 26, 30, a conduit having a nominal width greater than "a" can be effectively retained within housing 12. FIG. 3 illustrates frangible portion 48 removed from retaining members 24 and 28, and effectively retaining medium conduit 20' having a nominal width "b" in housing 12 by means of an interference fit.

Figure 4:
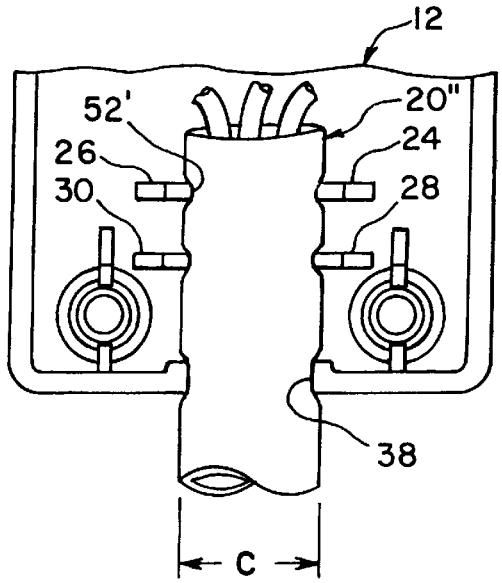
FIG. 4 is similar to FIGS. 2–3, but shows a large diameter conduit retained in the clamping mechanism wherein all four frangible portions have been removed.

When frangible portion 48 is removed from retaining members 24, 26, 28 and 30, a large conduit 20" having a nominal diameter greater than "b" can be effectively retained in housing 12. FIG. 4 illustrates a large conduit 20" having a nominal diameter "c" retained by retaining members 24, 26, 28, 30 after frangible portions 48 have been removed, and held in position by means of an interference fit.

Figure 7:
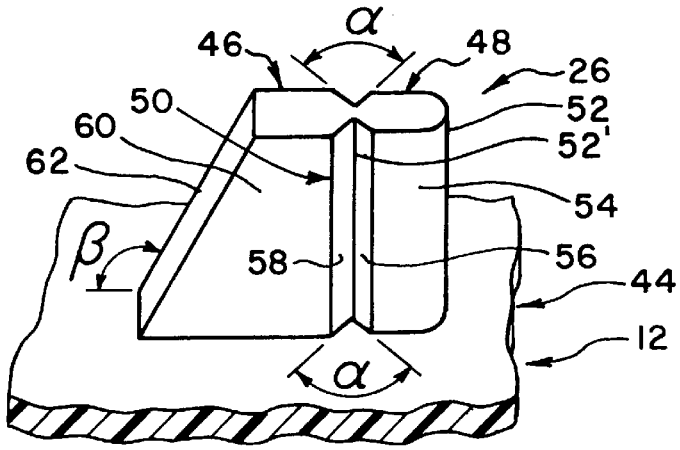
FIG. 7 is an enlarged perspective view of a retainer member having a frangible portion.

FIG. 7 is a perspective view of retaining member 26 attached to the inside front surface 44 of housing 12. The other retaining members 24, 28 and 30 are similarly constructed. Retaining member 26 has a fixed portion 46 and a frangible portion 48, separated by a reduced thickness break zone 50. A retaining edge 52 extends from the inside front surface 44 along the frangible portion 48. When the frangible portion 48 remains connected to retaining member 26, retaining edge 52 is part of the interference fit with conduit 20.

Frangible side edge 54 extends from the retaining edge 52 towards break zone 50. First break surface 56 is a continuation of frangible side surface 54 and is angled cut into the break zone 50. Second break surface 58 is separated from the first break surface 56 by angle $\alpha$ of about 90°–110°. The second break surface 58 is part of the fixed portion 46, and is connected to the fixed side surface 60.

Frangible portion 48 can be removed from the retaining member 26 and surface 44 of housing 12 by griping the frangible side surfaces 54 with a tool such as pliers, twisting the frangible portion 48 in the direction of the break zone 50 until frangible portion 48 separates at the break zone 50 and its connection to surface 44. This results in a new retaining edge 52' for retaining conduit 20' as seen, for example, in FIG. 3 regarding retaining members 24 and 28. Gripping tools other than pliers may be utilized to separate frangible portion 48 from the fixed portion 46, for example, a specialized tool that pinches or severs the retaining member 26 in break zone 50 along edge 52' can be fabricated. Additionally, if the retaining member is fabricated from a material that is more easily cut than cracked, a combination cutting and gripping tool may be used to separate frangible portion 48 from the fixed portion 46. The choice of tool will depend upon the material selected to fabricate the retaining member 26.

Fixed portion 46 has a fixed edge 62 opposite retaining edge 52. While retaining edge 52 is slightly less than perpendicular to the inside front surface 44, fixed edge 62 is angled towards the retaining edge 52 at an angle $\beta$ relative to the inside front surface 44 of about 60°.

It can be readily seen that a frangible portion 48 can be separated from any of retaining members 24, 26, 28, 30 in order to accommodate conduits 20, 20' and 20" having different predetermined nominal diameters a, b and c. That is, the size of the conduit that can be retained by retaining clamps 34, 36 can vary with the presence or absence of frangible portion 48.

Figure 8:
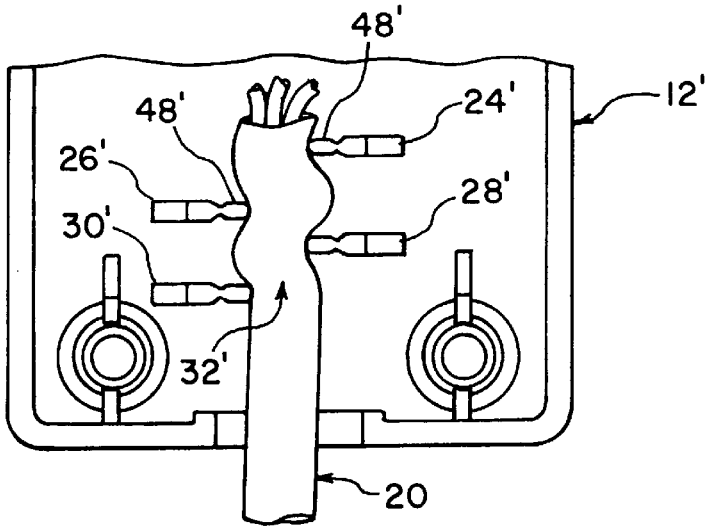
FIG. 8 is a rear elevational view of a second embodiment of the clamping mechanism with longitudinally offset retaining members.
Figure 9:
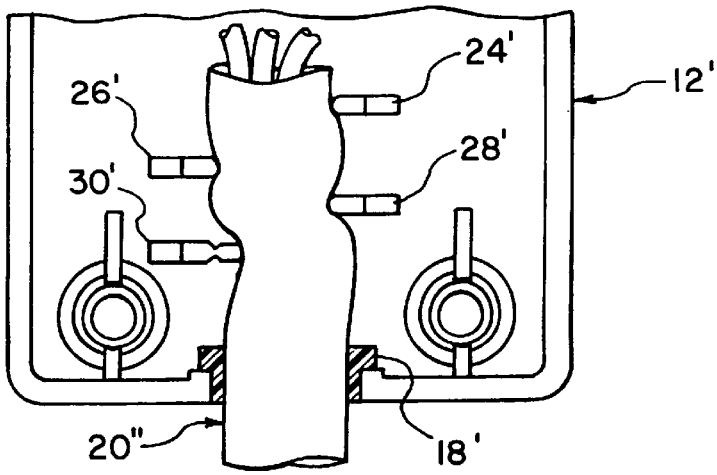
FIG. 9 is similar to FIG. 8, but shows three frangible portions removed from three retaining members and a larger diameter conduit retained.

Embodiment of FIGS. 8–9

FIGS. 8–9 depict a second embodiment of the present invention. Retaining members 24', 26', 28', 30' in housing 12' are alternately arranged and spaced on opposite sides of passageway 32'. In this manner, conduit 20 can be positioned between opposing retaining members 24', 26', 28', 30' in an S-shaped configuration. As with the first embodiment of FIGS. 1–7, frangible portions 48' can be removed from any of the retaining members 24', 26', 28', 30' in order to allow a conduit 20" having a larger diameter to be retained in passageway 32'.

As seen in FIG. 9, not all frangible portions 48' need to be removed from the retaining members 24', 26', 28', 30' in order to accommodate a larger diameter conduit 20". In FIG. 9, a frangible portion 48' is removed from retaining members 24', 26', 28', while frangible portion 48' is not removed from retaining member 30'. In this manner, retaining member 30' remains intact and acts as a pivot point for conduit 20" to exit housing 12' through grommet 18' in a generally linear manner.

Figure 10:
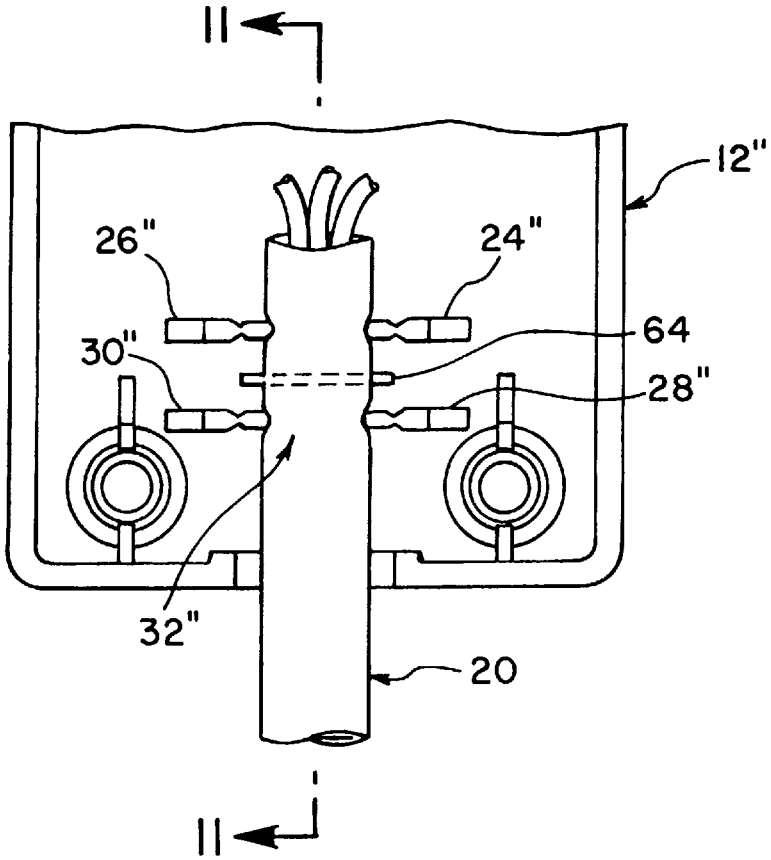
FIG. 10 is a rear elevational view of a third embodiment of the clamping mechanism with top and bottom retaining members.
Figure 11:
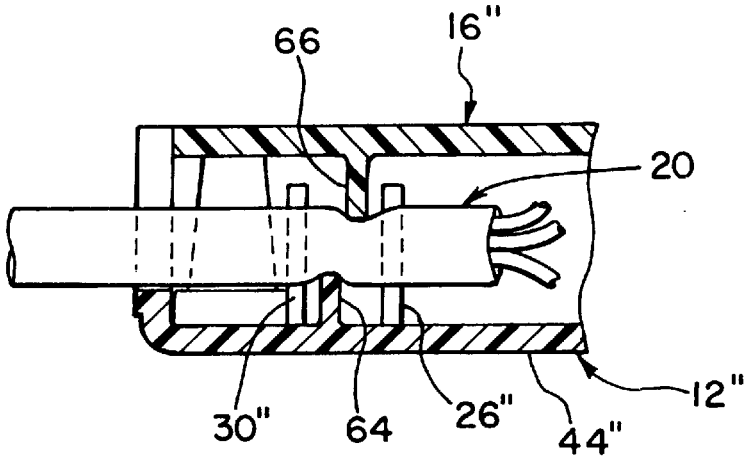
FIG. 11 is a cross-sectional view of the third embodiment of the electrical wiring device taken along line 11—11 of FIG. 10.

Embodiment of FIGS. 10 and 11

FIGS. 10 and 11 show a third embodiment of the present invention. A lower or bottom retaining member 64 is attached to the inside front surface 44" in passageway 32". Lower retaining member 64 is generally transverse to the longitudinal axis along passageway 32". FIG. 11 shows a cover 16" having an upper or top retaining member 66. When cover 16" is placed on housing 12" with a conduit 20 in place along passageway 32", the upper retaining member 66 cooperates with the lower retaining member 64 to retain conduit 20 with an interference fit. In the preferred configuration shown in FIG. 11, the upper retaining member 66 and lower retaining member 64 are longitudinally offset so as to retain the conduit rather than pinch conduit 20 and risk fracturing the wires or other components contained in conduit 20.

In all embodiments, only two opposing retaining members are usually required to adequately retain a conduit 20 with an interference fit. When at least one frangible portion 48 is removed from a retaining member 24, 26, 28, 30, a conduit 20 having a larger diameter can be held in place by an interference type fit.

It will be understood by those skilled in the art that various changes or modifications can be made herein without departing from the scope of the invention as defined in the appended claims.

What is claimed is:

1. An electrical wiring device comprising:

a housing having a passageway for receiving an electrical conduit therein;

clamping means, attached to said housing, for clamping the electrical conduit within said passageway;

said clamping means having a first retaining member and a second retaining member, said first and second retaining members located on opposite sides of said passageway;

said first retaining member having a first frangible portion and being located on one side of said passageway; and said second retaining member being located on another side of said passageway; and wherein the conduit having a first diameter is retained between said first and second retaining members.

2. The electrical wiring device of claim 1, wherein, when said first frangible portion is removed from said first retaining member, a second conduit having a second diameter greater than said first diameter can be retained between said first and second retaining members.

3. The electrical wiring device of claim 2, wherein said second retaining member further comprises a second frangible portion, wherein, when said second frangible portion is removed, a third conduit having a third diameter greater than said second diameter can be retained between said first and second retaining members.

4. The electrical wiring device of claim 1, and further comprising a third retaining member attached to said housing, said first, second and third retaining members alternating on opposite sides of said passageway, wherein, when the conduit is passed between said first, second and third retaining members the conduit is retained in a curve shape.

5. The electrical wiring device of claim 4, wherein, when said first frangible portion is removed from said first retaining member, a second conduit having a second diameter greater than said first diameter can be retained between said first, second and third retaining members.

6. The electrical wiring device of claim 5, wherein said second retaining member further comprises a second frangible portion, wherein, when said second frangible portion is removed, a third conduit having a third diameter greater than said second diameter can be retained between said first, second and third retaining members.

7. The electrical wiring device of claim 6, wherein said third retaining member further comprises a third frangible portion, wherein, when said third frangible portion is removed, a fourth conduit having a fourth diameter greater than said second diameter can be retained between said first, second and third retaining members.

8. The electrical wiring device of claim 1, wherein said clamping means further comprises a third retaining member attached to said housing, said third retaining member having a third frangible portion;

a fourth retaining member attached to said housing;

said third and fourth retaining members being located on opposite sides of said passageway and spaced a predetermined distance from said first and second retaining members; wherein the conduit is also retained between said third and fourth retaining members.

9. The electrical wiring device of claim 1, wherein said second retaining member further comprises a second frangible portion.

10. The electrical wiring device of claim 9, wherein said clamping means further comprising a third retaining member attached to said housing on the opposite side of said passageway from said first retaining member;

a fourth retaining member attached to said housing on the opposite side of said passageway from said second retaining member;

said first and third retaining members forming a first clamp and said second and fourth retaining members forming a second clamp;

wherein the conduit is retained by said first and second clamps.

11. The electrical wiring device of claim 10, wherein, when said first frangible portion is removed from said first retaining member and said second frangible portion is removed from said second retaining member, a second conduit having a second diameter greater than said first diameter can be retained by said first and second clamps.

12. The electrical wiring device of claim 11, wherein said third retaining member has a third frangible portion and said fourth retaining member has a fourth frangible portion; and wherein, when said third and fourth frangible portions are removed, a third conduit having a third diameter greater than said second diameter can be retained by said first and second clamps.

13. The electrical wiring device of claim 1, and further comprising a removable cover attachable to said housing, said cover having an upper retaining member;

a lower retaining member attached to said housing in said passageway;

wherein, when said cover is attached to said housing, said lower and upper retaining members engage the conduit.

14. The electrical wiring device of claim 13, wherein said lower and upper retaining members are separated longitudinally by a predetermined amount.

15. The electrical wiring device of claim 1, wherein the conduit is an electrical wire.

16. The electrical wiring device of claim 1, wherein the conduit is an optical fiber.

17. The electrical wiring device of claim 1, wherein the conduit is a coaxial cable.

18. An electrical wiring device comprising:

a housing having a passageway for receiving an electrical conduit therein;

a first clamping means, attached to said housing, for clamping the electrical conduit within said passageway;

said first clamping means having a first retaining member and a second retaining member, said first and second retaining members located on opposite sides of said passageway, said first and second retaining members separated by a first predetermined distance;

said first retaining member having a first frangible portion and being located on one side of said passageway;

said second retaining member having a second frangible portion and being located on another side of said passageway;

wherein the conduit having a first diameter is retained between said first and second retaining members;

wherein, when said first frangible portion is removed from said first retaining member, a second predetermined distance between said first retaining member and said second retaining member greater than the first distance results, and a second conduit having a second diameter greater than the first diameter can be retained between said first and second retaining members; and wherein, when said first and second frangible portions are removed from said first and second retaining members, a third predetermined distance greater than the first predetermined distance results, and a third conduit having a third diameter greater than the first diameter can be retained between said first and second retaining members.

19. The electrical wiring device of claim 18, and further comprising a second clamping means, attached to said housing, for clamping the electrical conduit within said passageway, said second clamping means being located a fourth predetermined distance apart from said first clamping means;

said second clamping means having a third retaining member and a fourth retaining member, said third and fourth retaining members located on opposite sides of said passageway, said third and fourth retaining members separated by a fifth predetermined distance;

said third retaining member having a third frangible portion and being located on one side of said passageway;

said fourth retaining member having a fourth frangible portion and being located on another side of said passageway;

wherein the conduit having a first diameter is retained between said first and second retaining members and between said third and fourth retaining members;

wherein, when said third frangible portion is removed from said third retaining member, the second predetermined distance between said first and second retaining members is also between said third and fourth retaining members, and the second conduit can be retained between said first and second retaining members and said third and fourth retaining members; and wherein, when said third and fourth frangible portions are removed from said third and fourth retaining members, the third predetermined distance between said third and fourth retaining members results, and the third conduit can be retained between said first and second retaining members and said third and fourth retaining members.

* * * * *